US011289005B2

(12) United States Patent
Sun et al.

(10) Patent No.: US 11,289,005 B2
(45) Date of Patent: Mar. 29, 2022

(54) DISPLAY DEVICE AND INTERFACE TYPE SELECTION METHOD THEREOF

(71) Applicant: Xianyang Caihong Optoelectronics Technology Co., Ltd, Xianyang (CN)

(72) Inventors: Lei Sun, Xianyang (CN); Yuanlian Wu, Xianyang (CN); Yuyeh Chen, Xianyang (CN); Zihan Liu, Xianyang (CN)

(73) Assignee: XIANYANG CAIHONG OPTOELECTRONICS TECHNOLOGY CO., LTD, Xianyang (CN)

( * ) Notice: Subject to any disclaimer, the term of this patent is extended or adjusted under 35 U.S.C. 154(b) by 0 days.

(21) Appl. No.: 17/024,868

(22) Filed: Sep. 18, 2020

(65) Prior Publication Data

US 2021/0082335 A1 Mar. 18, 2021

(30) Foreign Application Priority Data

Sep. 18, 2019 (CN) ..... 201910878920.6

(51) Int. Cl.
*G09G 3/20* (2006.01)

(52) U.S. Cl.
CPC ..... *G09G 3/2096* (2013.01); *G09G 2310/08* (2013.01); *G09G 2370/08* (2013.01); *G09G 2370/10* (2013.01)

(58) Field of Classification Search
CPC ..... G09G 3/2096; G09G 2310/08; G09G 2370/08; G09G 2370/10
See application file for complete search history.

(56) References Cited

U.S. PATENT DOCUMENTS

| | | | | |
|---|---|---|---|---|
| 2017/0025087 | A1* | 1/2017 | Liu | G09G 5/006 |
| 2019/0187546 | A1* | 6/2019 | Furihata | G03B 21/14 |
| 2020/0058722 | A1* | 2/2020 | Li | H01L 27/12 |
| 2021/0192092 | A1* | 6/2021 | Huang | G09G 3/2092 |

* cited by examiner

*Primary Examiner* — Kent W Chang
*Assistant Examiner* — Sujit Shah
(74) *Attorney, Agent, or Firm* — WPAT, PC

(57) ABSTRACT

A display device provided in the disclosure includes: a display panel including a gate driving circuit and a source driving circuit, a XB board including a driving circuit board assembly, and a system board including a system-on-chip and a second connector connected with the system-on-chip; the driving circuit board assembly includes a display control circuit and a first connector, the display control circuit is connected with the gate driving circuit, the source driving circuit and the first connector; the first connector includes voltage supplying pins, P2P interface pins and SPI pins; the second connector connects the first connector through a connecting member; the system-on-chip is configured for acquiring a type identification signal transmitted by the connecting member and identifying a P2P interface type according to the type identification signal; and transmitting corresponding P2P data to the connecting member according to the P2P interface type.

10 Claims, 11 Drawing Sheets

DISPLAY DEVICE AND INTERFACE TYPE SELECTION METHOD THEREOF

FIELD OF THE DISCLOSURE

The disclosure relates to the field of display technology, and more particularly to a display device and an interface type selection method thereof.

BACKGROUND

At present, in order to save cost, some liquid crystal television (LCD TV) manufacturers integrate a control board (or called as a TCON board) into a system board (or called as a main board) while designing. Therefore, it is not necessary to purchase control boards when purchasing LCD panels. This kind of product is called TCONLESS TV product.

In one application, a protocol of image data transmission between a system board and an LCD panel of a TCONLESS TV product is a P2P (Point-To-Point) interface protocol, so as to realize high-speed signal transmission. There are many kinds of P2P protocols currently, such as iSP (Integrated-Stream Protocol), USI-T(Unified Standard Interface for TV), CHPI(China BOE Point-to-Point Interface), CSPI (China Star Point-to-Point Interface), CMPI(Clock Embedded Point-to-Point Interface), CEDS(Clock Embedded Differential Signal), etc., which are applied to different LCD panel manufacturers.

With different P2P protocols, an image data format and a training method between TX (Transmit) and RX(Receive) will be different, which will result in different designs of system boards according to different P2P protocols, and the system boards cannot adapt to a variety of P2P protocols, and are of poor versatility.

SUMMARY

In order to overcome at least part of defects and deficiencies in the prior art, a display device provided in an embodiment of the disclosure includes: a display panel including a gate driving circuit and a source driving circuit, a horizontal direction circuit board (XB board) including a driving circuit board assembly, and a system board including a system-on-chip and a second connector electrically connected with the system-on-chip; the driving circuit board assembly includes a display control circuit and a first connector, the display control circuit is electrically connected with the gate driving circuit, the source driving circuit and the first connector, and the first connector includes voltage supplying pins, point-to-point (P2P) interface pins and serial peripheral interface (SPI) pins; the second connector is electrically connected with the first connector through a connecting member; the system-on-chip is configured for acquiring a type identification signal transmitted by the connecting member and identifying a P2P interface type according to the type identification signal, and further transmitting corresponding P2P data to the connecting member according to the P2P interface type.

In an embodiment of the disclosure, the P2P interface type is one selected from a group consisting of an Integrated-Stream Protocol (iSP) interface, an Unified Standard Interface for TV (USI-T), a China BOE Point-to-Point Interface (CHPI), a China Star Point-to-Point Interface (CSPI), a Clock Embedded Point-to-Point Interface (CMPI) and a Clock Embedded Differential Signal (CEDS) interface.

In an embodiment of the disclosure, the first connector further includes Inter-Integrated Circuit interface pins and/or reference timing signal pins.

In an embodiment of the disclosure, the reference timing signal pins includes: a start pulse signal pin (STV) and a clock signal pin (CKV).

In an embodiment of the disclosure, the reference timing signal pins includes: a start pulse signal pin (ST_in), a first high frequency clock signal pin (CK_in), a low frequency clock signal pin (LC_in) and a reset signal pin (RST_in).

In an embodiment of the disclosure, the reference timing signal pins includes: a start pulse signal pin (ST_in), a first high frequency clock signal pin (CK1_in), a second high frequency clock signal pin (CK2_in), a low frequency clock signal pin (LC_in) and a reset signal pin (RST_in).

In an embodiment of the disclosure, the reference timing signal pins includes: a start pulse signal pin (ST_in), a first high frequency clock signal pin (CK_in), a low frequency clock signal pin (LC_in), a reset signal pin (RST_in) and a terminate signal pin (Terminate_in).

In an embodiment of the disclosure, the reference timing signal pins includes: a start pulse signal pin (ST_in), a first high frequency clock signal pin (CK1_in), a second high frequency clock signal pin (CK2_in), a low frequency clock signal pin (LC_in), a reset signal pin (RST_in) and a terminate signal pin (Terminate_in).

An interface type selection method of a display device provided in an embodiment of the disclosure, includes: acquiring a type identification signal and identifying a P2P interface type according to the type identification signal; and transmitting a corresponding P2P data according to the P2P interface type; wherein the P2P interface type includes one or more of an Integrated-Stream Protocol (iSP) interface, an Unified Standard Interface for TV (USI-T), a China BOE Point-to-Point Interface (CHPI), a China Star Point-to-Point Interface (CSPI), a Clock Embedded Point-to-Point Interface (CMPI) and a Clock Embedded Differential Signal (CEDS) interface.

In an embodiment of the disclosure, the acquiring a type identification signal and identifying a P2P interface type according to the type identification signal, includes: acquiring a direct current (DC) voltage level data transmitted by a preset pin; comparing the DC voltage level data with the preset value stored in advance to and identifying the P2P interface type corresponding to the DC voltage level data; the DC voltage level data is a type identification signal.

In an embodiment of the disclosure, the acquiring a type identification signal and identifying a P2P interface type according to the type identification signal, includes: acquiring a clock signal and at least one high/low voltage level signals transmitted by predetermined pins; judging times of occurrence of the at least high/low voltage level signals in a time period of the clock signal; and identifying the P2P interface type according to the times of occurrence; wherein the type identification signal includes the clock signal and the at least one high/low voltage level signal transmitted by the predetermined pins.

In an embodiment of the disclosure, the acquiring a type identification signal and identifying a P2P interface type according to the type identification signal, includes: acquiring an alternating current (AC) voltage level signal with a preset rule transmitted by a predetermined pin; judging a ratio between a high voltage level and a low voltage level in the AC voltage level signal with the preset rule; identifying the P2P interface type according to the ratio; wherein the type identification signal is the AC voltage level signal with the preset rule.

In an embodiment of the disclosure, the acquiring a type identification signal and identifying a P2P interface type according to the type identification signal, includes: acquiring the type identification signal stored in a predetermined memory; identifying the P2P interface type according to the type identification signal.

In an embodiment of the disclosure, the predetermined memory is a flash memory, and the type identification signal is transmitted through a serial peripheral interface (SPI).

In an embodiment of the disclosure, the predetermined memory is an electrically erasable programmable read-only memory (EEPROM), and the type identification signal is transmitted through an inter-integrated circuit (IIC) interface.

An interface type selection method of a display device provided in an embodiment of the disclosure; the display device includes: a display panel including a gate driving circuit and a source driving circuit; a horizontal direction circuit board (XB board) including a driving circuit board assembly, a system board including a system-on-chip and a second connector electrically connected with the system-on-chip; the driving circuit board assembly includes a display control circuit and a first connector, the display control circuit is electrically connected with the gate driving circuit, the source driving circuit and the first connector, and the first connector includes voltage supplying pins, point-to-point (P2P) interface pins and serial peripheral interface (SPI) pins; the second connector is electrically connected with the first connector through a connecting member; the interface type selection method is performed by the system-on-chip and includes: acquiring a type identification signal and identifying a P2P interface type according to the type identification signal; and transmitting a corresponding P2P data according to the P2P interface type; the P2P interface type includes one or more of an Integrated-Stream Protocol (iSP) interface, an Unified Standard Interface for TV (USI-T), a China BOE Point-to-Point Interface (CHPI), a China Star Point-to-Point Interface (CSPI), a Clock Embedded Point-to-Point Interface (CMPI) and a Clock Embedded Differential Signal (CEDS) interface In the above-mentioned display device and interface type selection method thereof, the system board judges the corresponding P2P interface type after acquiring a type identification signal transmitted by a connecting member, which makes the system board be more versatile, and can realize universal design of SOC (System-On-Chip) for different P2P interfaces and improve the applicability of the system board. In addition, the disclosure can judge the type of P2P interface without increasing the total pin number of the connector, which further improves the applicability of connecting member.

BRIEF DESCRIPTION OF THE DRAWINGS

In order to more clearly illustrate technical solutions of embodiments of the disclosure, drawings used in the embodiments will be briefly introduced below. Apparently, the drawings in the description below are merely some embodiments of the disclosure, a person skilled in the art can obtain other drawings according to these drawings without creative efforts.

DETAILED DESCRIPTION OF EMBODIMENTS

Figure 1:
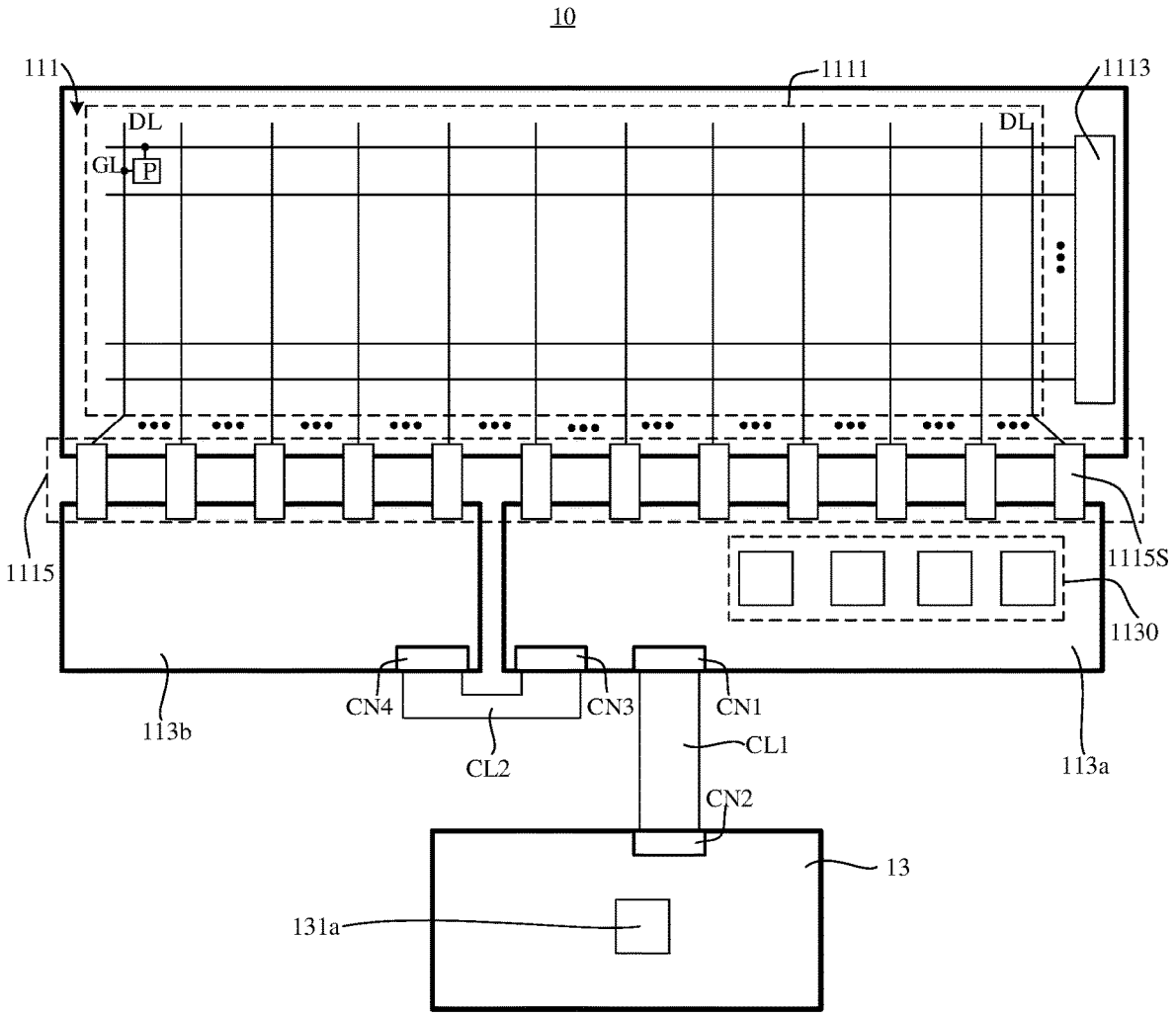
FIG. 1 is a schematic structural view of an active matrix display device according to an embodiment of the disclosure.

In order to make objective(s), technical solutions and advantages of embodiments of the disclosure clearer, technical solutions of embodiments of the disclosure will be clearly and fully described in the following with reference to the accompanying drawings in the embodiments of the disclosure. Apparently, the described embodiments are some of the embodiments of the disclosure, but not all of the embodiments of the disclosure. All other embodiments obtained by the skilled person in the art based on the described embodiments of the disclosure without creative efforts are within the scope of protection of the instant application.

The following description of the embodiments is referred to the additional schematic views to illustrate specific embodiments of the disclosure that can be implemented. Directional terms mentioned in the disclosure, such as "up", "down", "front", "back", "left", "right", "inside", "outside" and "side surface" are only directions referring to the additional schematic views. Therefore, directional terms are used to explain and understand the disclosure, rather than to limit the disclosure.

The drawings and illustrations are considered to be illustrative in nature rather than restrictive. In the drawings, units with similar structure are represented by a same label. In addition, for the sake of understanding and easy description, size and thickness of each unit shown in the drawings are shown arbitrarily, but the disclosure is not limited to this.

In addition, in the specification, unless explicitly described to the contrary, the word "include" will be understood to mean including a unit, and but does not exclude any other unit. In addition, in the specification, "on" means to be above or below a target unit, and not to mean that it must be on top based on a direction of gravity.

In order to further elaborate the technical solutions and efficacy adopted by the disclosure to achieve the intended objective(s) of the disclosure, specific implementation, structure, characteristics and efficacy of a display device and its interface type selection proposed according to the disclosure in combination with the drawings and preferred embodiments are described in detail.

As shown in FIG. 1, an active matrix display device 10 provided in an embodiment of the disclosure includes: an active matrix panel, a system board 13 and a connecting member CL1. The active matrix panel is, for example, a liquid crystal panel, which includes a display panel 111 and a XB board which includes a source driving circuit board assembly. The active matrix display device 10 in the embodiment is, for example, a TCONLESS-type LCD TV, but the embodiment of the disclosure is not limited to this.

Specifically, the display panel 111 includes a display area 1111 and a gate driving circuit 1113 and a source driving circuit 1115 electrically connected with the display area 1111. The display area 1111 is provided with a plurality of data lines DL, a plurality of gate lines GL and a plurality of pixels P electrically connecting with data lines DL and gate lines GL; each pixel P is located at an intersection of a corresponding gate line GL and a corresponding data line DL. The gate driving circuit 1113 is for example a one-sided GOA (Gate-On Array) circuit or a bilateral GOA circuit. For a one-sided GOA circuit, it is located in a peripheral area which is on one side of the display area 1111, such as a left side or a right side; for a bilateral GOA circuit, it is located in a peripheral area of the display area 1111 and is arranged on two opposite sides of the display area 1111. The gate driving circuit 1113 is electrically connected to the gate lines GL in the display area 1111 and is configured for providing gate driving signals to the plurality of gate lines GL in the display area 1111. The source driving circuit 1115 includes, for example, a plurality of COF-type source drivers 1115S, such as twelve COF (Chip-On-Flex) source drivers 1115S shown in FIG. 1. The plurality of COF source drivers 1115S are electrically connected to the data lines DL in the display area 1111 and are configured for providing image data signals to the plurality of data lines DL. More specifically, a single COF-type source driver 1115S includes, for example, a flexible circuit board and a source driver IC arranged on the flexible circuit board.

As a circuit board assembly connected with the source driving circuit 1115, the source driving circuit board assembly includes two driving circuit boards 113*a* and 113*b*. The two driving circuit boards 113*a* and 113*b* are arranged on one side of the display panel 111 along the horizontal direction of FIG. 1, that is, as a horizontal direction driving circuit board (commonly known as an X-Board). A connecting interface of the COF-type 1115S is arranged on one side of the driving circuit board 113*a* and 113*b* adjacent to the display area 1111, such as a mini LVDS interface or a P2P interface. Specifically, the driving circuit board 113*a* is provided with a display control circuit 1130, a connector CN1 and a connector CN3. The driving circuit board 113*a* is electrically connected to the display area 1111 through a plurality of source drivers, for example, seven COF-type source drivers 1115S. The driving circuit board 113*b* is provided with a connector CN4. The driving circuit board 113*b* is electrically connected to the display area 1111 through a plurality of source drivers, for example, five COF-type source drivers 1115S. The connector CN3 of the driving circuit board 113*a* is electrically connected with the connector CN4 of the driving circuit board 113*b* through a connecting member CL2. The connecting member CL2 is, for example, a flexible circuit board or a flexible flat cable (FFC).

The system board 13 includes a connector CN2 and a system-on-chip 131*a*. The connector CN2 of the system board 13 is connected with the connector CN1 of the driving circuit board 113*a* through the connecting member CL1. The connecting member CL1 is, for example, a single flexible flat cable (FFC), especially when the number of the driving circuit board in the source driving circuit board assembly is even. In this way, the system board 13 transmits control signals and all digital video image signals required by the active matrix panel (such as a liquid crystal panel) to the source driving circuit board assembly only through a single flexible flat cable (rather than through a plurality of flexible flat cables); the digital video image signals, for example, includes all RGB data required by the active matrix panel. It should be noted here that, a single flexible cable typically includes two connectors and a plurality of signal lines connected between the two connectors. In addition, it is worth mentioning that, the system board 13 of the embodiment is typically provided with a plurality of audio and video input interfaces, such as CVBS (Composite Video Broadcast Signal) interface, HDMI (High Definition Multimedia Interface) interface, etc.; the system board 13 is also called a main board, and is configured for decoding video image and audio signals inputted through the plurality of audio and video input interfaces, and then outputting the video image signal to the source driving circuit board assembly in digital signal format.

The system-on-chip 131*a* is configured for acquiring a type identification signal transmitted by the connecting member CL1 and identifying a corresponding P2P interface type according to the type identification signal; and transmitting corresponding P2P data according to the P2P interface type. Specifically, P2P interface types is one selected from a group consisting of an Integrated-Stream Protocol (iSP) interface, an Unified Standard Interface for TV (USI-T), a China BOE Point-to-Point Interface (CHPI), a China Star Point-to-Point Interface (CSPI), a Clock Embedded Point-to-Point Interface (CMPI) and a Clock Embedded Differential Signal (CEDS) interface. The above interface types are only common centralized P2P interface protocols. Different panel manufacturers also have their own P2P protocol(s). The P2P interface types of the disclosure are not limited to the above types, as long as the protocols designed by P2P mode can be implemented through the disclosure.

In an embodiment of the disclosure, the connector CN1 further includes IIC (Inter-Integrated Circuit) interface pins and/or reference timing signal pins.

By the above, the connector CN1 and connector CN2 in the embodiment have the same pin number and pin function definition, and the pin number is 60. Take the functional composition of different pins as an example to illustrate. For more details, please refer to tables 1-4 attached below.

TABLE 1 pin definition of a first connector connecting the system board and the XB board

| number of pin | name of pin | description of pin |
|---|---|---|
| 1 | Vin | votage supplying |
| 2 | Vin | |
| 3 | Vin | |
| 4 | Vin | |
| 5 | Vin | |
| 6 | Vin | |
| 7 | Vin | |
| 8 | Vin | |
| 9 | NC | empty |

TABLE 1-continued

| pin definition of a first connector connecting the system board and the XB board | | |
|---|---|---|
| number of pin | name of pin | description of pin |
| 10 | GND | ground |
| 11 | GND | |
| 12 | GND | |
| 13 | GND | |
| 14 | P2P-12+ | P2P interface |
| 15 | P2P-12− | |
| 16 | GND | ground |
| 17 | P2P-11+ | P2P interface |
| 18 | P2P-11− | |
| 19 | GND | ground |
| 20 | P2P-10+ | P2P interface |
| 21 | P2P-10− | P2P interface |
| 22 | GND | ground |
| 23 | P2P-9+ | P2P interface |
| 24 | P2P-9− | |
| 25 | GND | ground |
| 26 | P2P-8+ | P2P interface |
| 27 | P2P-8− | |
| 28 | GND | ground |
| 29 | P2P-7+ | P2P interface |
| 30 | P2P-7− | |
| 31 | GND | ground |
| 32 | P2P-6+ | P2P interface |
| 33 | P2P-6− | |
| 34 | GND | ground |
| 35 | P2P-5+ | P2P interface |
| 36 | P2P-5− | |
| 37 | GND | ground |
| 38 | P2P-4+ | P2P interface |
| 39 | P2P-4− | |
| 40 | GND | ground |
| 41 | P2P-3+ | P2P interface |
| 42 | P2P-3− | |
| 43 | GND | ground |
| 44 | P2P-2+ | P2P interface |
| 45 | P2P-2− | |
| 46 | GND | ground |
| 47 | P2P-1+ | P2P interface |
| 48 | P2P-1− | |
| 49 | GND | ground |
| 50 | LOCK/BCC/CRD | P2P interface |
| 51 | NC | empty |
| 52 | HC_WP | HC interface |
| 53 | HC_SCL | |
| 54 | HC_SDA | |
| 55 | SPI_CS | SPI interface |
| 56 | SPI_DI | |
| 57 | SPI_DO | |
| 58 | SPI_DCK | |
| 59 | STV | reference timing social |
| 60 | CKV | |

TABLE 2

| pin definition of a second connector connecting the system board and the XB board | | |
|---|---|---|
| number of pin | name of pin | description of pin |
| 1 | Vin | votage supplying |
| 2 | Vin | |
| 3 | Vin | |
| 4 | Vin | |
| 5 | Vin | |
| 6 | Vin | |
| 7 | Vin | |
| 8 | Vin | |
| 9 | NC | empty |
| 10 | GND | ground |
| 11 | GND | |
| 12 | GND | |
| 13 | P2P-12+ | P2P interface |

TABLE 2-continued

| pin definition of a second connector connecting the system board and the XB board | | |
|---|---|---|
| number of pin | name of pin | description of pin |
| 14 | P2P-12− | |
| 15 | GND | ground |
| 16 | P2P-11+ | P2P interface |
| 17 | P2P-11− | |
| 18 | GND | ground |
| 19 | P2P-10+ | P2P interface |
| 20 | P2P-10− | |
| 21 | GND | ground |
| 22 | P2P-9+ | P2P interface |
| 23 | P2P-9− | |
| 24 | GND | ground |
| 25 | P2P-8+ | P2P interface |
| 26 | P2P-8− | |
| 27 | GND | ground |
| 28 | P2P-7+ | P2P interface |
| 29 | P2P-7− | |
| 30 | GND | ground |
| 31 | P2P-6+ | P2P interface |
| 32 | P2P-6− | |
| 33 | GND | ground |
| 34 | P2P 5+ | P2P interface |
| 35 | P2P-5− | |
| 36 | GND | ground |
| 37 | P2P-4+ | P2P interface |
| 38 | P2P-4− | |
| 39 | GND | ground |
| 40 | P2P-3+ | P2P interface |
| 41 | P2P-3− | P2P interface |
| 42 | GND | ground |
| 43 | P2P-2+ | P2P interface |
| 44 | P2P-2− | |
| 45 | GND | ground |
| 46 | P2P-1+ | P2P interface |
| 47 | P2P-1− | |
| 48 | GND | ground |
| 49 | SFC | P2P interface |
| 50 | SRF | |
| 51 | SPI_CS | SPI interface |
| 52 | SPI_DI | |
| 53 | SPI_DO | |
| 54 | SPI_DCK | |
| 55 | ST_in | reference timing signal |
| 56 | CK1_in | |
| 57 | CK2_in | |
| 58 | RST_in | |
| 59 | LC_in | |
| 60 | Terminate_in | |

TABLE 3

| pin definition of a third connector connecting the system board and the XB board | | |
|---|---|---|
| member of pin | name of pin | description of pin |
| 1 | Vin | votage supplying |
| 2 | Vin | |
| 3 | Vin | |
| 4 | Vin | |
| 5 | Vin | |
| 6 | Vin | |
| 7 | Vin | |
| 8 | Vin | |
| 9 | NC | empty |
| 10 | GND | ground |
| 11 | GND | |
| 12 | GND | |
| 13 | GND | |
| 14 | P2P-12+ | P2P interface |
| 15 | P2P-12− | |
| 16 | GND | ground |
| 17 | P2P-11+ | P2P interface |

TABLE 3-continued

| pin definition of a third connector connecting the system board and the XB board | | |
|---|---|---|
| member of pin | name of pin | description of pin |
| 18 | P2P-11− | |
| 19 | GND | ground |
| 20 | P2P-10+ | P2P interface |
| 21 | P2P-10− | P2P interface |
| 22 | GND | ground |
| 23 | P2P-9+ | P2P interface |
| 24 | P2P-9− | |
| 25 | GND | ground |
| 26 | P2P-8+ | P2P interface |
| 27 | P2P-8− | |
| 28 | GND | ground |
| 29 | P2P-7+ | P2P interface |
| 30 | P2P-7− | |
| 31 | GND | ground |
| 32 | P2P-6+ | P2P interface |
| 33 | P2P-6− | |
| 34 | GND | ground |
| 35 | P2P-5+ | P2P interface |
| 36 | P2P-5− | |
| 37 | GND | ground |
| 38 | P2P-4+ | P2P interface |
| 39 | P2P-4− | |
| 40 | GND | ground |
| 41 | P2P-3+ | P2P interface |
| 42 | P2P-3− | |
| 43 | GND | ground |
| 44 | P2P-2+ | P2P interface |
| 45 | P2P-2− | |
| 46 | GND | ground |
| 47 | P2P-1+ | P2P interface |
| 48 | P2P-1− | |
| 49 | GND | ground |
| 50 | LOCK/BCC/CRD | P2P interface |
| 51 | NC | empty |
| 52 | HC_WP | HC interface |
| 53 | HC_SCL | |
| 54 | HC_SDA | |
| 55 | SPI_CS | SPI interface |
| 56 | SPI_DI | |
| 57 | SPI_DO | |
| 58 | SPI_DCK | |
| 59 | NC | blank connection |
| 60 | NC | |

TABLE 4

| pin definition of a fourth connector connecting the system board and the XB board | | |
|---|---|---|
| number of pin | name of pin | description of pin |
| 1 | Vin | votage supplying |
| 2 | Vin | |
| 3 | Vin | |
| 4 | Vin | |
| 5 | Vin | |
| 6 | Vin | |
| 7 | Vin | |
| 8 | Vin | |
| 9 | NC | empty |
| 10 | GND | ground |
| 11 | GND | |
| 12 | GND | |
| 13 | P2P-12+ | P2P interface |
| 14 | P2P-12− | |
| 15 | GND | ground |
| 16 | P2P-11+ | P2P interface |
| 17 | P2P-11− | |
| 18 | GND | ground |
| 19 | P2P-10+ | P2P interface |
| 20 | P2P-10− | |
| 21 | GND | ground |

TABLE 4-continued

| pin definition of a fourth connector connecting the system board and the XB board | | |
|---|---|---|
| number of pin | name of pin | description of pin |
| 22 | P2P-9+ | P2P interface |
| 23 | P2P-9− | |
| 24 | GND | ground |
| 25 | P2P-8+ | P2P interface |
| 26 | P2P-8− | |
| 27 | GND | ground |
| 28 | P2P-7+ | P2P interface |
| 29 | P2P-7− | |
| 30 | GND | ground |
| 31 | P2P-6+ | P2P interface |
| 32 | P2P-6− | |
| 33 | GND | ground |
| 34 | P2P-5+ | P2P interface |
| 35 | P2P-5− | |
| 36 | GND | ground |
| 37 | P2P-4+ | P2P interface |
| 38 | P2P-4− | |
| 39 | GND | ground |
| 40 | P2P-3+ | P2P interface |
| 41 | P2P-3− | P2P interface |
| 42 | GND | ground |
| 43 | P2P-2+ | P2P interface |
| 44 | P2P-2− | |
| 45 | GND | ground |
| 46 | P2P-1+ | P2P interface |
| 47 | P2P-2− | |
| 48 | GND | ground |
| 49 | SFC | P2P interface |
| 50 | SRF | |
| 51 | SPI_CS | SPI interface |
| 52 | SPI_DI | |
| 53 | SPI_DO | |
| 54 | SPI_DCK | |
| 55 | NC | empty |
| 56 | NC | |
| 57 | NC | |
| 58 | NC | |
| 59 | NC | |
| 60 | NC | |

The pin definition of the 60-pin connector in Table 1 includes five parts: voltage supplying, P2P interface, IIC interface, SPI interface and reference timing signal. The placement positions of each part can be exchanged. The pin definition of the 60-pin connector in Table 2 includes four parts: voltage supplying, P2P interface, SPI interface and reference timing signal. The placement positions of each part can be exchanged. The pin definition of the 60-pin connector in Table 3 includes four parts: voltage supplying, P2P interface, IIC interface and SPI interface. The placement positions of each part can be exchanged. The pin definition of the 60-pin connector in Table 4 includes three parts: voltage supplying, P2P interface and SPI interface. The placement positions of each part can be exchanged.

Illustratively, in the above pin combination modes of the 60-pin connector, if the reference timing signal is included, the reference timing signal can be transmitted by two pins: an start pulse signal pin (STV) and a clock signal pin (CKV); or, it can be transmitted by four pins: an start pulse signal pin (ST_in), a first high frequency clock signal pin (CK_in), a low frequency clock signal pin (LC_in) and a reset signal pin (RST_in); or it can be transmitted by 5 pins: an start pulse signal pin (ST_in), a first high frequency clock signal pin (CK1_in), a second high frequency clock signal pin (CK2_in), a low frequency clock signal (LC_in) pin and a reset signal (RST_in) pin; or it can be transmitted by the following 5 pins: an start pulse signal pin (ST_in), a first high frequency clock signal pin (CK_in), a low frequency clock signal pin (LC_in), a reset signal pin (RST_in) and a terminate signal pin (Terminate_in); or it can be transmitted by 6 pins: an start pulse signal pin (ST_in), a first high frequency clock signal pin (CK1_in), a second high frequency clock signal pin (CK2_in), a low frequency clock signal pin (LC_in), a reset signal pin (RST_in) and a terminate signal pin (Terminate_in).

Additionally, the P2P interface further includes a pair of pins for clock training between the TX and the RX beside 12 pairs of P2P data interface pins. For different P2P protocols, the pin number and pin definition of clock training pins are different. The pin number of clock training pins is usually one or two. For example, ISP interface is configured for transmitting lock signal, and USI-T interface includes a SFC pin and a SRF pin. Of course, the specific pin number of the P2P interface depends on the type of signal.

In the display device of the embodiment, the system board judges the corresponding P2P interface type after acquiring a type identification signal transmitted by a connecting member, which makes the system board more versatile, and can realize universal design of SOC for different P2P interfaces and improve the applicability of the system board.

Second Embodiment

In an embodiment of the disclosure, the acquiring a type identification signal and identifying a P2P interface type according to the type identification signal, includes:

acquiring a direct current (DC) voltage level data transmitted by a predetermined pin;

comparing the DC voltage level data with a preset value stored in advance to identify the P2P interface type corresponding to the DC voltage level data;

the DC voltage level data is the type identification signal.

In this embodiment, as a P2P type selection module to transmit the type identification signal, one pin is added to the 60-pin connectors of the system board and the XB board to set high and low voltage levels. In one illustration, the added pin uses original empty pin in the 60-pin connectors, and does not increase the total number of 60-pin connectors. The system board judges the P2P type by reading the setting value and makes a correct clock training action.

The definition of the 60-pin connector can include voltage supplying pins, P2P type selection pins, P2P interface pins, IIC interface pins, SPI interface pins and reference timing signal pins; it can also include voltage supplying pins, P2P type selection pins, P2P interface pins, SPI interface pins and reference timing signal pins; it can also include voltage supplying pins, P2P type selection pins, P2P interface pins, IIC interface pins and SPI interface pins; and it can also include voltage supplying pins, P2P type selection pins, P2P interface pins and SPI interface pins. In order to explain the solutions of the embodiment more clearly, interfaces in Table 5 are takes as examples in the embodiment, and see Table 5 for details.

TABLE 5 an example of pin definition of 60-pin connector in the second embodiment

| number of pin | name of pin | description of pin |
|---|---|---|
| 1 | Vin | votage supplying |
| 2 | Vin | |
| 3 | Vin | |
| 4 | Vin | |
| 5 | Vin | |

TABLE 5-continued an example of pin definition of 60-pin connector in the second embodiment

| number of pin | name of pin | description of pin |
|---|---|---|
| 6 | Vin | |
| 7 | Vin | |
| 8 | Vin | |
| 9 | NC | empty |
| 10 | GND | ground |
| 11 | GND | |
| 12 | P2P_SEL1 | P2P type selection |
| 13 | P2P_SEL2 | |
| 14 | P2P-12+ | P2P interface |
| 15 | P2P-12− | |
| 16 | GND | ground |
| 17 | P2P-11+ | P2P interface |
| 18 | P2P-11− | |
| 19 | GND | ground |
| 20 | P2P-10+ | P2P interface |
| 21 | P2P-10− | P2P interface |
| 22 | GND | ground |
| 23 | P2P-9+ | P2P interface |
| 24 | P2P-9− | |
| 25 | GND | ground |
| 26 | P2P-8+ | P2P interface |
| 27 | P2P-8− | |
| 28 | GND | ground |
| 29 | P2P-7+ | P2P interface |
| 30 | P2P-7− | |
| 31 | GND | ground |
| 32 | P2P-6+ | P2P interface |
| 33 | P2P-6− | |
| 34 | GND | ground |
| 35 | P2P-5+ | P2P interface |
| 36 | P2P-5− | |
| 37 | GND | ground |
| 38 | P2P-4+ | P2P interface |
| 39 | P2P-4− | |
| 40 | GND | ground |
| 41 | P2P-3+ | P2P interface |
| 42 | P2P-3− | |
| 43 | GND | ground |
| 44 | P2P-2+ | P2P interface |
| 45 | P2P-2− | |
| 46 | GND | ground |
| 47 | P2P-1+ | P2P interface |
| 48 | P2P-1− | |
| 49 | GND | ground |
| 50 | LOCK/BCC/CRD | P2P interface |
| 51 | NC | empty |
| 52 | HC_WP | HC interface |
| 53 | HC_SCL | |
| 54 | HC_SDA | |
| 55 | SPI_CS | SPI interface |
| 56 | SPI_DI | |
| 57 | SPI_DO | |
| 58 | SPI_DCK | |
| 59 | STV | reference timing signal |
| 60 | CKV | |

The pin number of preset pins in the embodiment is set according to the actual situation. If the pin number of the preset pins is one, there are at most two P2P types to be selected; if it is two, there are at most four P2P types to be selected; if it is three, there are at most eight P2P types to be selected, and so on; please refer to table 5, FIGS. 2, and 3, two pins P2P_SEL1 and P2P_Sel2 are taken as an example for illustration, and the boot logic is that, after booting (or power on), the system board firstly reads HL setting of P2P_SEL1 and P2P_SEL2, identifies the correct P2P type, judges the definition of the P2P interface at the same time, selects the corresponding training mode in SOC to make clock training action between the TX and the Rx. After the training is successful, the display panel will start normally.

In this embodiment, the DC voltage level data are permutation and combination of the voltage levels transmitted by the added pins. If it includes one pin, there are two modes, H and L; if it includes two pins, there are four modes, LL, LH, HL, HH; if it includes three pins, there are eight modes, LLL, LLH, . . . , HHL, HHH, and so on.

Figure 2:
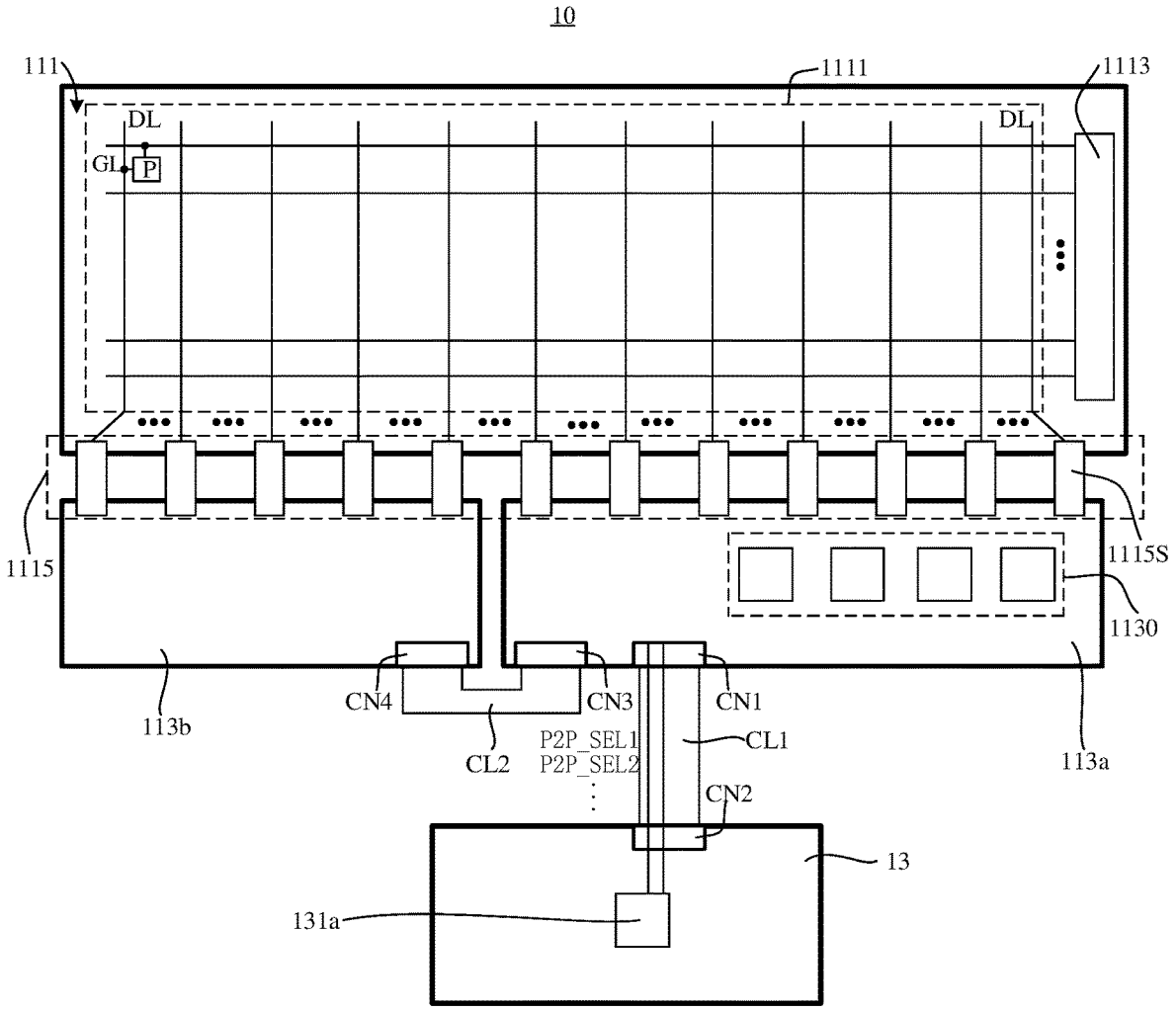
FIG. 2 is a schematic structural view of an active matrix display device according to a second embodiment of the disclosure.
Figure 3:
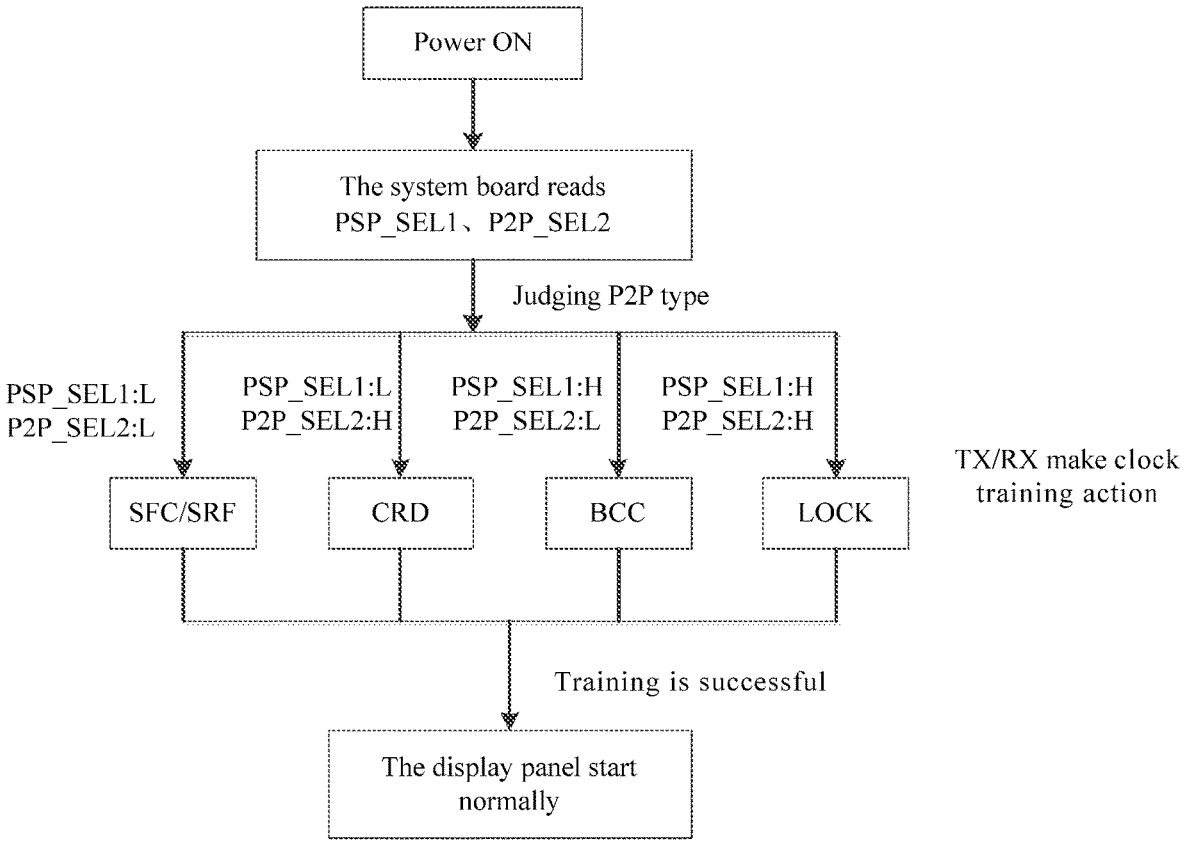
FIG. 3 is a schematic view of a boot logic according to the second embodiment of the disclosure.

Please refer to FIGS. 2 and 3, for example, if the pre-stored setting values are that: LL corresponding to SFC/SRF, LH corresponding to CRD, HL corresponding to BCC, and HH corresponding to lock. After reading the data of P2P_SEL1, P2P_SEL2, the system board judges the P2P type according to the above rules, and the corresponding training mode is selected in SOC, and make the clock training between the TX and the Rx. After the training is successful, the display panel will start normally.

The disclosure can judge the type of P2P interface without increasing the total pin number of the connector, which further improves the applicability of connecting member. In addition, by judging the high and low voltage level directly, the P2P type can be easily and quickly identified by the system board without increasing additional calculation.

Third Embodiment

In an embodiment of the disclosure, the acquiring a type identification signal and identifying a corresponding P2P interface type(s) according to the type identification signal, includes:

acquiring a clock signal and at least one high/low voltage level signals transmitted by predetermined pins;

judging times of occurrence of the at least high/low voltage level signals in a time period of the clock signal;

identifying the P2P interface type according to the times of occurrence;

the type identification signal includes the clock signal and the at least one high/low voltage level signal transmitted by the predetermined pins.

In this embodiment, two pins are added to the 60-pin connectors of the system board and XB, one of which is used to transmit P2P selection clock signal (SEL_CLK) for defining clock period; the other one of which is used to transmit P2P selection data signal (SEL_DO) for transmitting high and low voltage levels. As a P2P type selection module, the added two pins can arranged to the original empty pins in 60-pin connector without increasing the total pin number of 60-pin connector. The system board judges the P2P type by reading the number of the high and low voltage levels, and makes a corresponding clock training action.

The pin definition of 60-pin connector can include voltage supplying pins, P2P type selection pins, P2P interface pins, IIC interface pins, SPI interface pins and reference timing signal pins; it can also include voltage supplying pins, P2P type selection pins, P2P interface pins, SPI interface pins and reference timing signal pins; it can also include voltage supplying pins, P2P type selection pins, P2P interface pins, IIC interface pins and SPI interface pins; and it can also include voltage supplying pins, P2P type selection pins, P2P interface pins and SPI interface pins. In order to explain the solutions of the embodiment more clearly, interfaces in Table 6 are takes as examples in the embodiment, and see Table 6 for details.

TABLE 6 an example of pin definition of 60-pin connector in the third embodiment

| number of pin | name of pin | description of pin |
|---|---|---|
| 1 | Vin | votage supplying |
| 2 | Vin | |
| 3 | Vin | |
| 4 | Vin | |
| 5 | Vin | |
| 6 | Vin | |
| 7 | Vin | |
| 8 | Vin | |
| 9 | NC | empty |
| 10 | GND | ground |
| 11 | GND | |
| 12 | SEL_CLK | P2P type selection |
| 13 | SEL_DO | |
| 14 | P2P-12+ | P2P interfaee |
| 15 | P2P-12− | |
| 16 | GND | ground |
| 17 | P2P-11+ | P2P interface |
| 18 | P2P-11− | |
| 19 | GND | ground |
| 20 | P2P-10+ | P2P interface |
| 21 | P2P-10− | P2P interface |
| 22 | GND | ground |
| 23 | P2P-9+ | P2P interface |
| 24 | P2P-9− | |
| 25 | GND | ground |
| 26 | P2P-8+ | P2P interface |
| 27 | P2P-8− | |
| 28 | GND | ground |
| 29 | P2P-7+ | P2P interface |
| 30 | P2P-7− | |
| 31 | GND | ground |
| 32 | P2P-6+ | P2P interface |
| 33 | P2P-6− | |
| 34 | GND | ground |
| 35 | P2P-5+ | P2P interface |
| 36 | P2P-5− | |
| 37 | GND | ground |
| 38 | P2P-4+ | P2P interface |
| 39 | P2P-4− | |
| 40 | GND | ground |
| 41 | P2P-3+ | P2P interface |
| 42 | P2P-3− | |
| 43 | GND | ground |
| 44 | P2P-2+ | P2P interface |
| 45 | P2P-2− | |
| 46 | GND | ground |
| 47 | P2P-1+ | P2P interface |
| 48 | P2P-1− | |
| 49 | GND | ground |
| 50 | LOCK/BCC/CRD | P2P interface |
| 51 | NG | empty |
| 52 | HC_WP | HC interface |
| 53 | HC_SCL | |
| 54 | EC_SDA | |
| 55 | SPI_CS | SPI interface |
| 56 | SPI_DI | |
| 57 | SPI_DO | |
| 58 | SPI_DCK | |
| 59 | STV | reference timing signal |
| 60 | CKV | |

Figure 4:
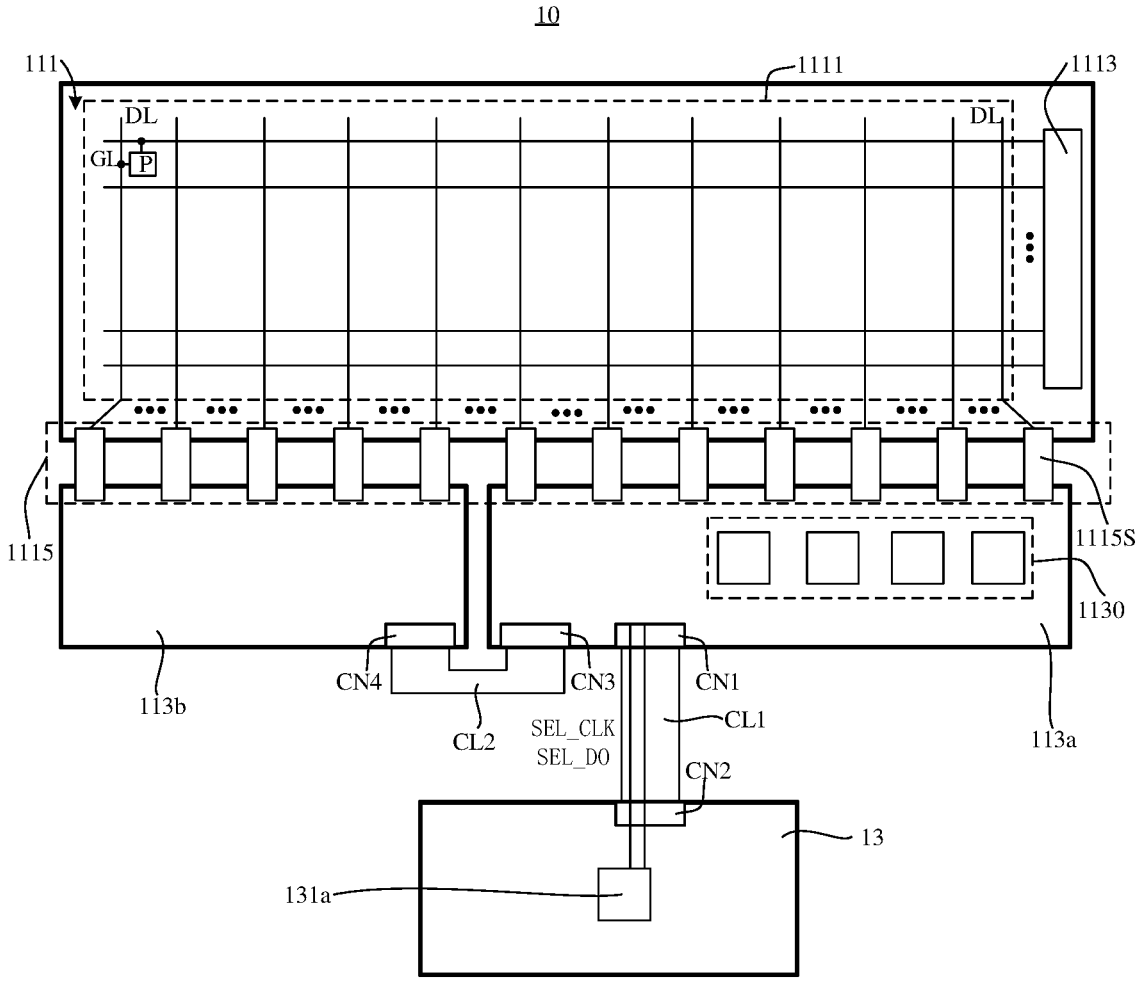
FIG. 4 is a schematic structural view of an active matrix display device according to a third embodiment of the disclosure.
Figure 5:
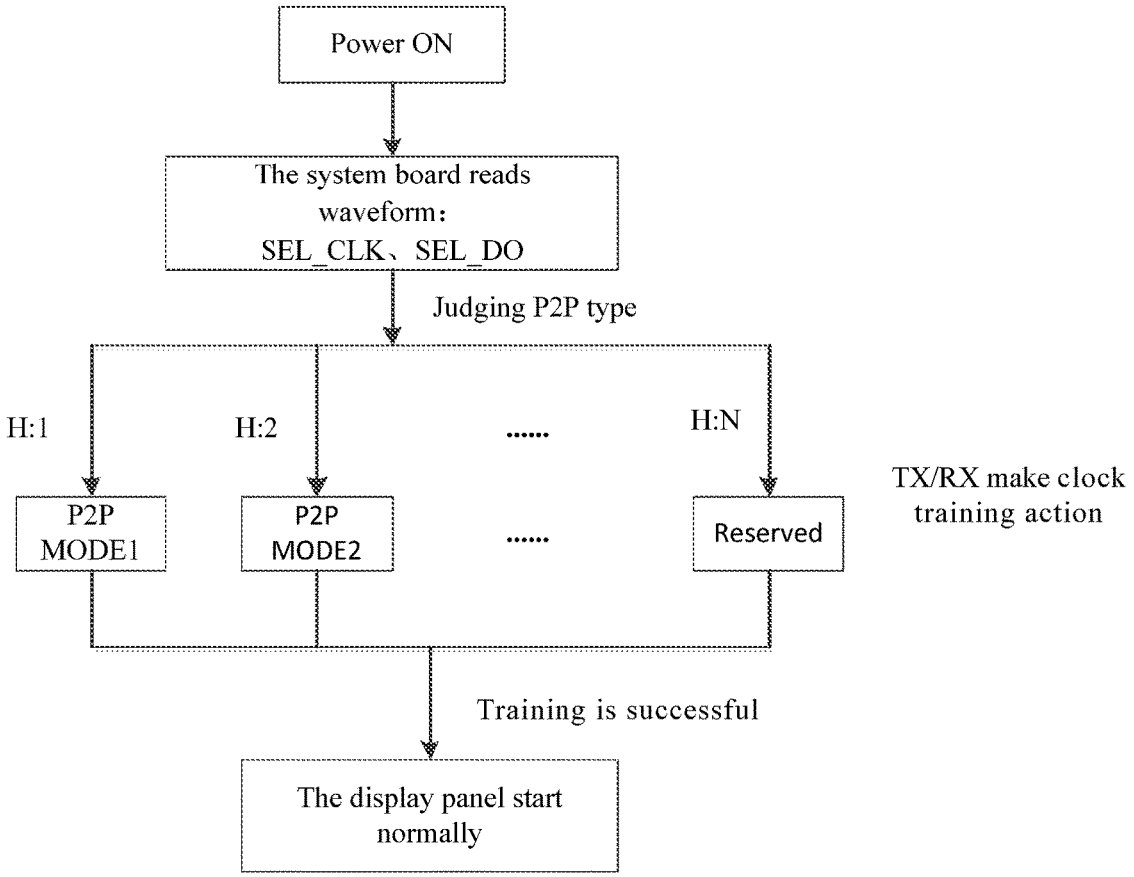
FIG. 5 is a schematic view of a boot logic according to the third embodiment of the disclosure.

Please refer to FIGS. 4 and 5. After booting (or power on), the system board uses the SEL_CLK as a clock signal, identifies times of occurrence of high or low voltage level transmitted by SEL_DO pin, judges the P2P type, and makes a corresponding clock training action. After the training is successful, the display panel will start normally. For example, if the times of occurrence of the high or low voltage level is 1, the P2P type will be judged as P2P MODE1; if the times of occurrence of the high or low voltage level is 2, the P2P type will be judged as P2P MODE2; if the times of occurrence of the high or low voltage level is 3, the P2P type will be judged as P2P Mode3, and so on.

Figure 6:
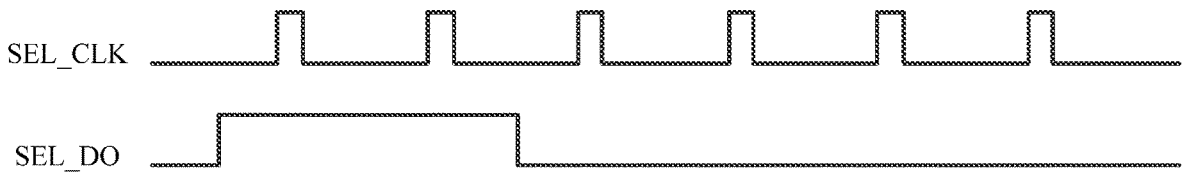
FIG. 6 is a schematic view of an SEL_DO signal waveform according to the third embodiment of the disclosure.

Specifically, SEL_DO transmitting high level is taken as an example. Times of occurrence of the high voltage level signals in a time period of the clock signal is judged according to the clock period of SEL_CLK. As shown in FIG. 6, there are twice of occurrence of high voltage level signals of SEL_DO in total appears in the time period of the clock signal of the SEL_CLK, therefore, P2P mode2 is judged according to the times of occurrence 2. The embodiment does not limit the specific times of occurrence-mode comparison, it can be set according to the actual situation. For example, if the times of occurrence 2 are preset as MODE1 in advance, it is judged as P2P MODEL The type of P2P interface can be judged without increasing the total pin number of the connector in the embodiment, which further improves the applicability of the connector. No matter how many P2P type selections are, the selection signal pins are fixed to two pins, which can greatly save the pin number of the connector when there are too many P2P types.

Fourth Embodiment

In an embodiment of the disclosure, the acquiring a type identification signal and identifying a P2P interface type according to the type identification signal, includes:

acquiring an alternating current (AC) voltage level signal with a preset rule transmitted by a predetermined pin;

judging a ratio between a high voltage level and a low voltage level in the AC voltage level signal with the preset rule;

identifying the P2P interface type according to the ratio;

the type identification signal is the AC voltage level signal with the preset rule.

In this embodiment, one pin is added to the 60-pin connectors of the system board and the XB board as the P2P selection data signal (P2P_SEL) for transmitting high and low voltage levels. The system board calculates a ratio between a high voltage level and a low voltage level, or counts the high and low voltage levels through the internal clock of SOC, judges the P2P type and make a corresponding clock training action.

The pin definition of 60-pin connectors can include voltage supplying pins, P2P type selection pins, P2P interface pins, IIC interface pins, SPI interface pins and reference timing signal pins; it can also include voltage supplying pins, P2P type selection pins, P2P interface pins, SPI interface pins and reference timing signal pins; it can also include voltage supplying pins, P2P type selection pins, P2P interface pins, IIC interface pins and SPI interface pins; and it can also include voltage supplying pins and P2P type selection pins, P2P interface pins and SPI interface pins. In order to explain the solutions of the embodiment more clearly, interfaces in Table 7 are takes as examples in the embodiment, and see Table 7 for details.

TABLE 7 an example of pin definition of 60-pin connector in the fourth embodiment

| number of pin | name of pin | description of pin |
|---|---|---|
| 1 | Vin | votage supplying |
| 2 | Vin | |

TABLE 7-continued an example of pin definition of 60-pin connector in the fourth embodiment

| number of pin | name of pin | description of pin |
|---|---|---|
| 3 | Vin | |
| 4 | Vin | |
| 5 | Vin | |
| 6 | Vin | |
| 7 | Vin | |
| 8 | Vin | |
| 9 | NC | empty |
| 10 | GND | ground |
| 11 | GND | |
| 12 | SEL_CLK | P2P type selection |
| 13 | SEL_DO | |
| 14 | P2P-12+ | P2P interface |
| 15 | P2P-12− | |
| 16 | GND | ground |
| 17 | P2P-11+ | P2P interface |
| 18 | P2P-11− | |
| 19 | GND | ground |
| 20 | P2P-10+ | P2P interface |
| 21 | P2P-10− | P2P interface |
| 22 | GND | ground |
| 23 | P2P-9+ | P2P interface |
| 24 | P2P-9− | |
| 25 | GND | ground |
| 26 | P2P-8+ | P2P interface |
| 27 | P2P-8− | |
| 28 | GND | ground |
| 29 | P2P-7+ | P2P interface |
| 30 | P2P-7− | |
| 31 | GND | ground |
| 32 | P2P-6+ | P2P interface |
| 33 | P2P-6− | |
| 34 | GND | ground |
| 35 | P2P-5+ | P2P interface |
| 36 | P2P-5− | |
| 37 | GND | ground |
| 38 | P2P-4+ | P2P interface |
| 39 | P2P-4− | |
| 40 | GND | ground |
| 41 | P2P-3+ | P2P interface |
| 42 | P2P-3− | |
| 43 | GND | ground |
| 44 | P2P 2+ | P2P interface |
| 45 | P2P-2− | |
| 46 | GND | ground |
| 47 | P2P-1+ | P2P interface |
| 48 | P2P-1− | |
| 49 | GND | ground |
| 50 | LOCK/BCC/CRD | P2P interface |
| 51 | NC | empty |
| 52 | HC_WP | HC interface |
| 53 | HC_SCL | |
| 54 | HC_SDA | |
| 55 | SPI_CS | SPI interface |
| 56 | SPI_DI | |
| 57 | SPI_DO | |
| 58 | SPI_DCK | |
| 59 | STV | reference timing signal |
| 60 | CKV | |

Figure 7:
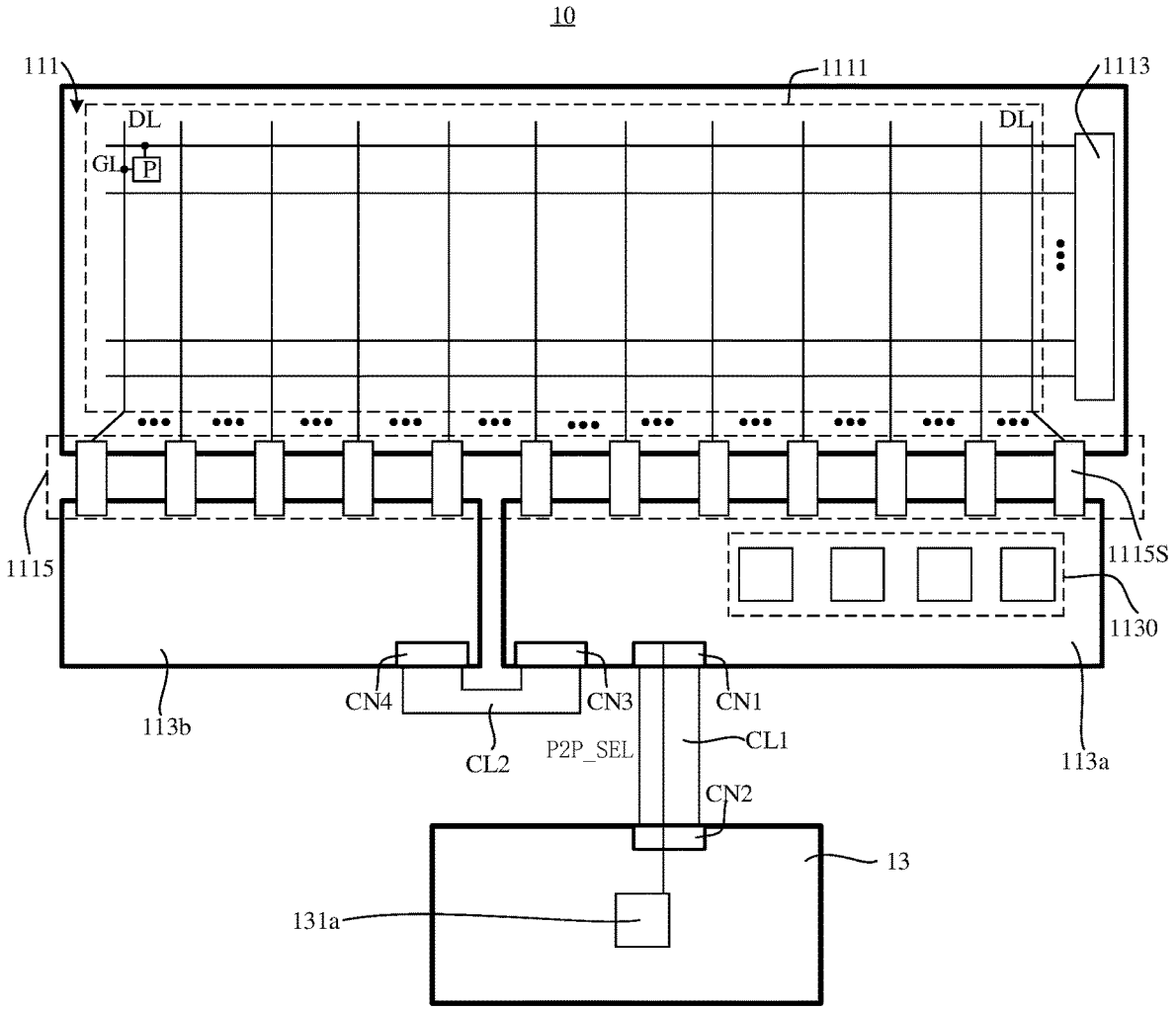
FIG. 7 is a schematic structural view of an active matrix display device according to a fourth embodiment of the disclosure.
Figure 8:
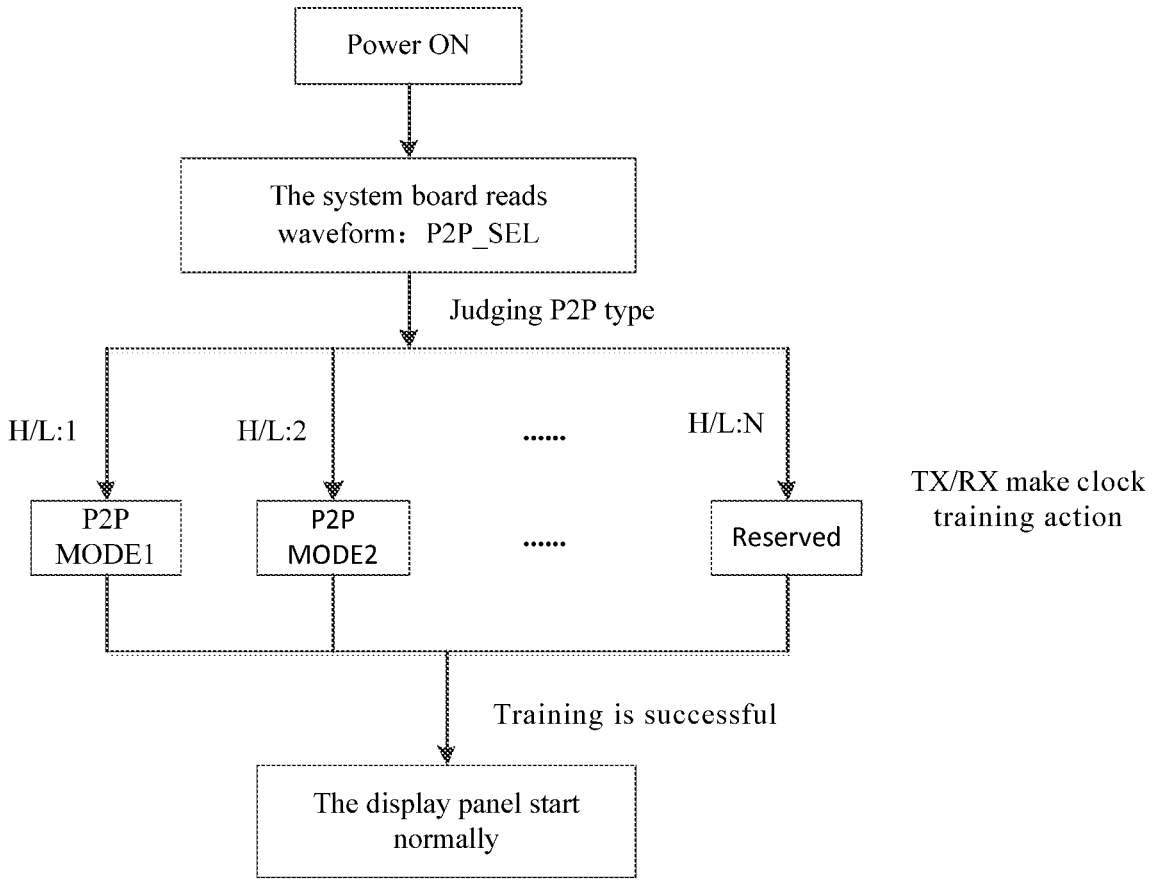
FIG. 8 is a schematic view of a boot logic according to the fourth embodiment of the disclosure.

Please refer to FIGS. 7 and 8. After booting, the system board identifies and calculates the ratio of high level to high level transmitted by P2P_SEL pin, judges the P2P type, and makes a correct clock training action. After the training is successful, the display panel will start normally.

Figure 9:
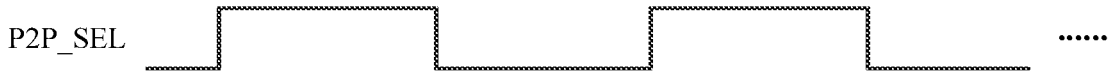
FIG. 9 is a schematic view of a P2P_SEL signal waveform according to the fourth embodiment of the disclosure.

Specifically, please refer to FIG. 9, if the ratio of "high voltage level/low voltage level" in P2P_SEL is 1, the P2P type is judged as P2P MODE1, if the ratio of "high voltage level/low voltage level" in P2P_SEL is 2, the P2P type is judged as P2P MODE 2. Of course, this embodiment does not limit the specific ratio-mode comparison. It can be set according to the actual situation. For example, if the preset ratio 1 is preset as MODE2 in advance, it is judged as P2P MODE2. In addition, the above P2P_SEL can be periodic, for example, the P2P_SEL waveform in sequence includes 3 high voltage levels, 1 low voltage level, 3 high voltage levels, 1 low voltage level, then the ratio of "high voltage level/low voltage level" can be directly judged according to the voltage level situation in a period; it can also be aperiodic, and the ratio of "high voltage level/low voltage level" can be judged by judging the ratio of times of occurrence of the high voltage level and times of occurrence of the low voltage level in a preset time. Of course, there are also other judgment methods. The embodiment does not limit the judgment by the ratio judgment method above.

The type of P2P interface can be judged without increasing the total pin number of connector in the embodiment, which further improves the applicability of the connector. No matter how many P2P type selections are, the selection signal pin is fixed to one pin, which can save more pins.

Fifth Embodiment

In an embodiment of the disclosure, the acquiring a type identification signal and identifying a P2P interface type according to the type identification signal, includes:

acquiring the type identification signal stored in a predetermined memory;

identifying the P2P interface type according to the type identification signal.

In an embodiment of the disclosure, the predetermined memory is a FLASH memory, and and the type identification signal is transmitted through a serial peripheral interface (SPI).

In an embodiment of the disclosure, the predetermined memory is an electrically erasable programmable read-only memory (EEPROM), and the type identification signal is transmitted through an inter-integrated circuit (IIC) interface.

In this embodiment, the P2P type identification signal is stored in the predetermined memory, and the existing pin of the 60-pin connector is used to transmit P2P type identification signal to the system board. After receiving the P2P type identification signal, the system board judges the P2P type and makes a corresponding clock training action.

Figure 10:
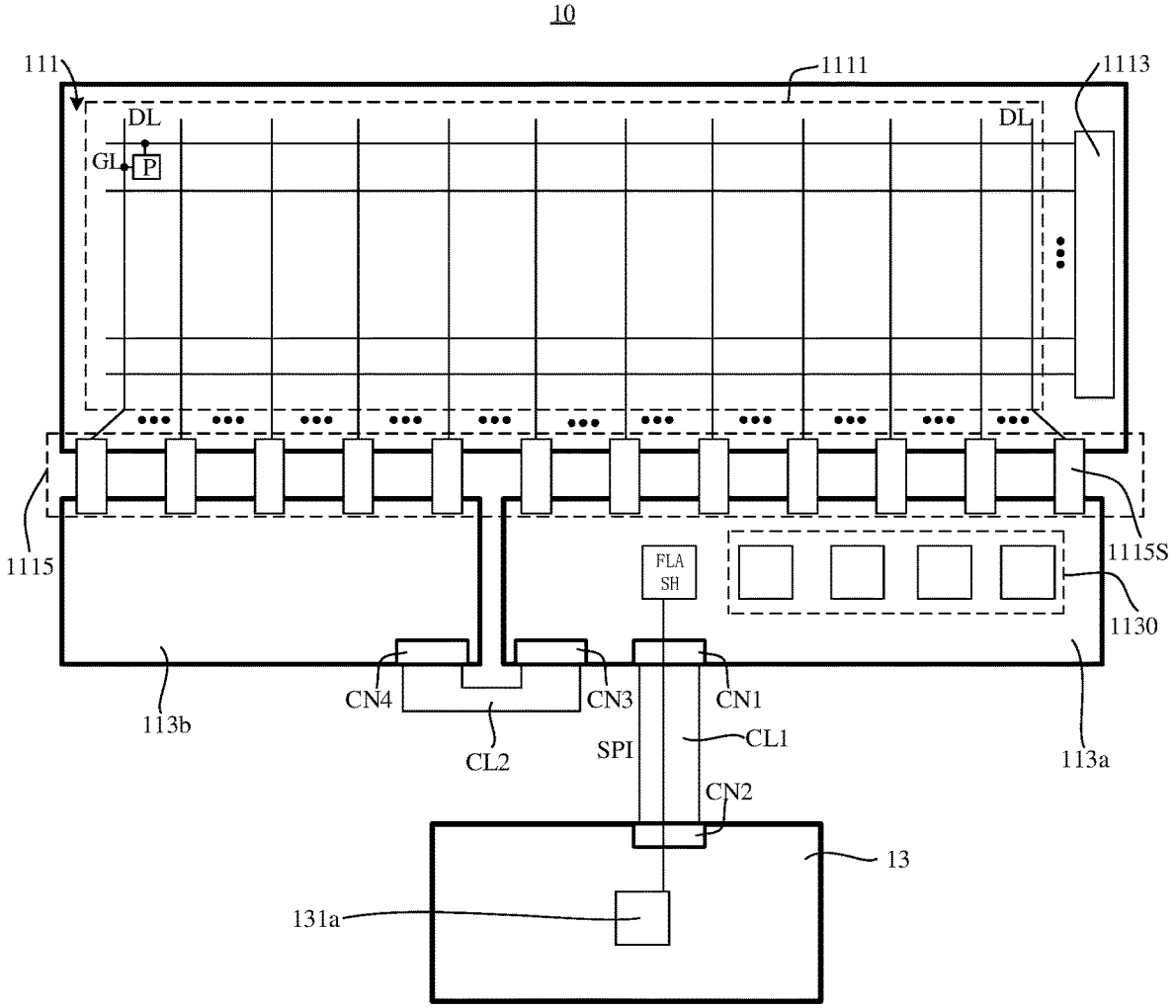
FIG. 10 is a schematic structural view of an active matrix display device with P2P identifications stored in FLASH memory according to a fifth embodiment of the disclosure.
Figure 11:
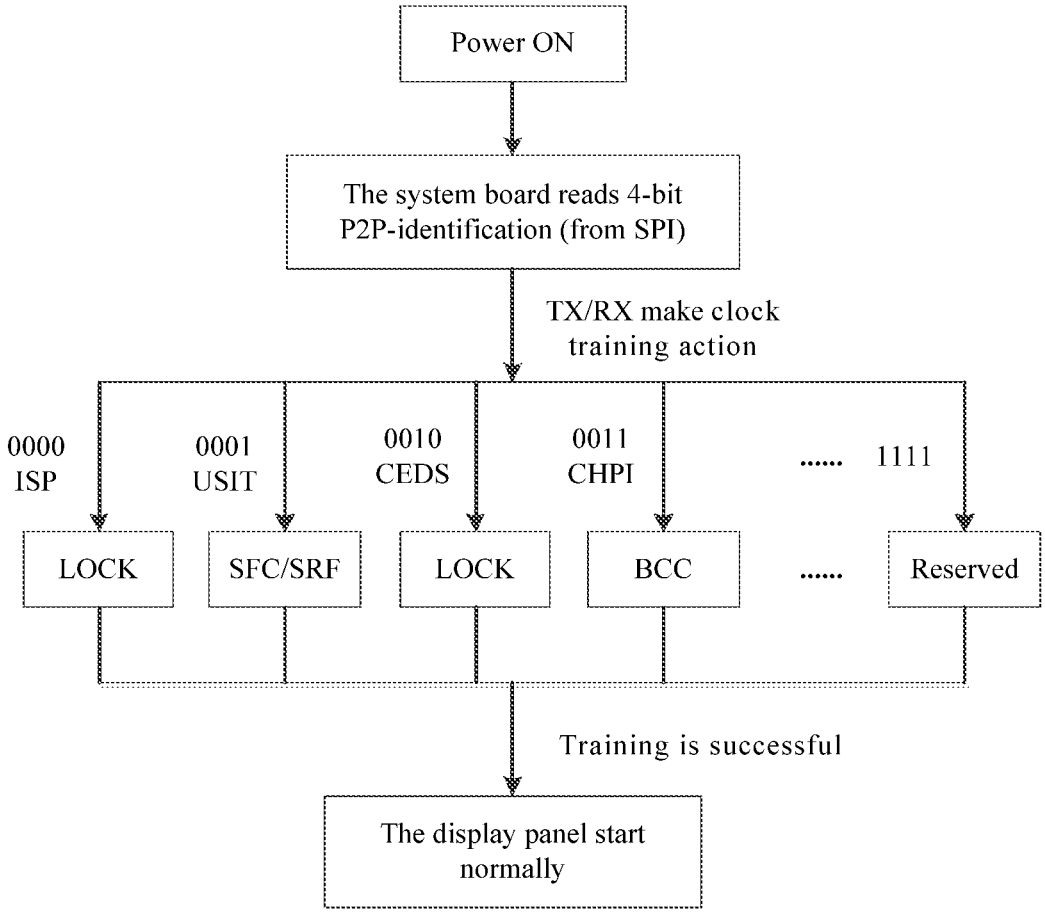
FIG. 11 is a schematic view of a boot logic with P2P identifications stored in FLASH memory according to the fifth embodiment of the disclosure.

Please refer to FIGS. 10 and 11, if the P2P type identification signal is stored in a FLASH MEMORY of the XB board, the SPI pins transmit the P2P type identification signal to the system board. Therefore, it is necessary to add 4-bit data in the SPI signal in advance as the P2P identification. After booting and receiving the data stored in a FLASH memory transmitted by SPI_DO, the system board firstly reads the P2P type identification signal, judges the P2P type, and makes a correct training action. After the training is successful, the data will be transmitted in a correct P2P data format, and the display panel will start normally.

Figure 12:
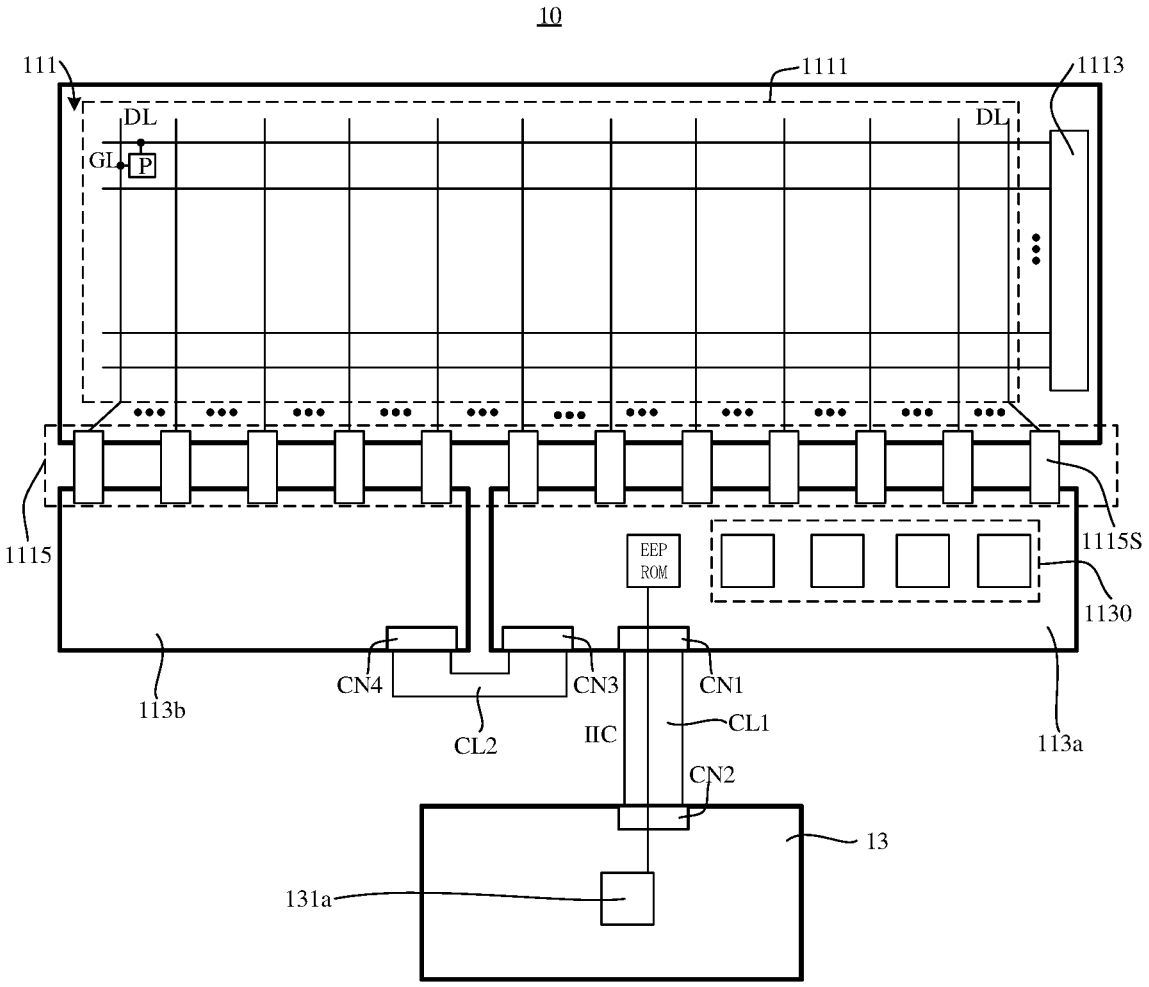
FIG. 12 is a schematic structural view of an active matrix display device with P2P identifications stored in EEPROM according to the fifth embodiment of the disclosure.
Figure 13:
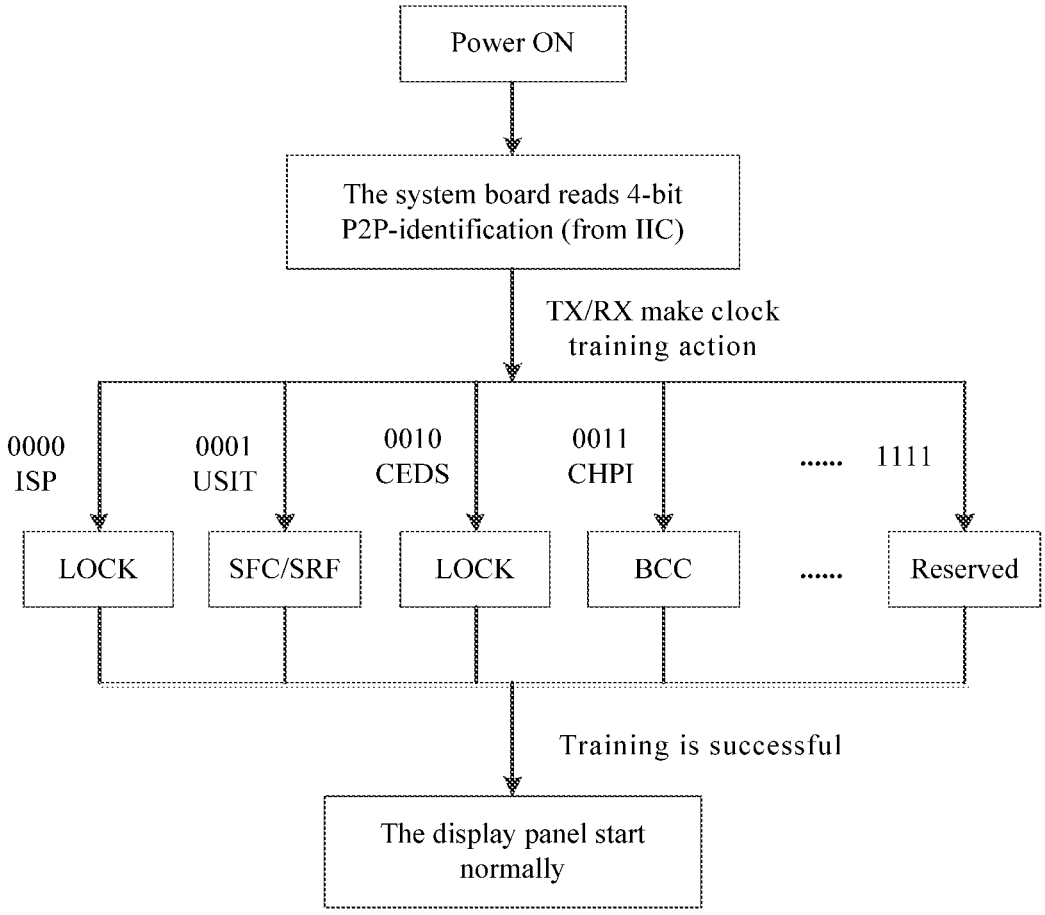
FIG. 13 is a schematic view of a boot logic with P2P identifications stored in EEPROM according to the fifth embodiment of the disclosure.

Or, please refer to FIGS. 12 and 13, if the P2P type identification signal is stored in an EEPROM of the XB board, 4-bit data is added to the IIC signal as the P2P identification in advance. After booting, receiving the data stored in the EEPROM transmitted by IIC_SDA, the system board firstly reads the P2P type identification signal, judges the P2P type, and makes a correct training action. After the training is successful, the data will be transmitted in a correct P2P data format, and the display panel will start normally.

Of course, the P2P type corresponding to the 4-bit data above-mentioned can be set in advance according to the actual situation, as long as it is consistent with the judgment conditions in the system board. In addition, it is not limited to 4-bit data and can be determined according to the number of P2P types.

The type of P2P interface can be judged without increasing the total pin number of connector, which further improves the applicability of the connector. In addition, the embodiment does not need to use additional pins. By storing the P2P type identification directly in the predetermined memory on the XB board, the system board reads the P2P type identification directly after booting and can judge the P2P interface type.

The terms "in some embodiments" and "in various embodiments" are repeatedly used. The term above usually does not refer to the same embodiment; however, it may also refer to the same embodiment. Words such as "composed", "have" and "include" are synonyms, unless the context shows other meanings.

The above are only preferred embodiments of the disclosure, and do not limit the disclosure in any form, although the disclosure has been disclosed in the preferred embodiments as above, it is not intended to limit the disclosure, any person skilled in the art, without departing from the scope of the technical solutions of the disclosure, can use the technical contents disclosed above to make some alterations or modifications to equivalent embodiments of equivalent changes, but if they do not deviate from the technical solution contents of the disclosure, any simple modifications, equivalent changes made to the above embodiments by the technical essence of the disclosure still fall within the scope of the technical solutions of the disclosure.

What is claimed is:

1. A display device comprising:

a display panel, comprising a gate driving circuit and a source driving circuit;

a horizontal direction circuit board (XB board), comprising a driving circuit board assembly, wherein the driving circuit board assembly comprises a display control circuit and a first connector, the display control circuit is electrically connected with the gate driving circuit, the source driving circuit and the first connector, and the first connector comprises voltage supplying pins, point-to-point (P2P) interface pins and serial peripheral interface (SPI) pins, the P2P interface pins comprise at least one clock training pin for clock training and P2P data interface pins; and a system board, comprising a system-on-chip and a second connector electrically connected with the system-on-chip, wherein the second connector is electrically connected with the first connector through a connecting member;

wherein the system-on-chip is configured for acquiring a type identification signal transmitted by at least one designated pin of the first connector and the connecting member from the driving circuit board assembly after booting, identifying a P2P interface type according to the type identification signal and thereby selecting a corresponding training mode in the system-on-chip to make an action of clock training, and further transmitting corresponding P2P data with a correct data format to the source driving circuit via the connecting member and the P2P data interface pins of the first connector according to the P2P interface type after the clock training is successful;

wherein the at least one designated pin of the first connector is at least one P2P type selection pin of the first connector, Inter-Integrated Circuit interface pins of the first connector, or the serial peripheral interface pins of the first connector;

wherein the P2P interface type is corresponding to one of P2P interface protocols.

2. The display device as claimed in claim 1, wherein the P2P interface type is one selected from a group consisting of an Integrated-Stream Protocol (iSP) interface, an Unified Standard Interface for TV (USI-T), a China BOE Point-to-Point Interface (CHPI), a China Star Point-to-Point Interface (CSPI), a Clock Embedded Point-to-Point Interface (CMPI) and a Clock Embedded Differential Signal (CEDS) interface.

3. The display device as claimed in claim 1, wherein the first connector further comprises Inter-Integrated Circuit interface pins and/or reference timing signal pins.

4. The display device as claimed in claim 3, wherein the reference timing signal pins comprises: a start pulse signal pin (STV) and a clock signal pin (CKV).

5. The display device as claimed in claim 3, wherein the reference timing signal pins comprises: a start pulse signal pin (ST_in), a first high frequency clock signal pin (CK_in), a low frequency clock signal pin (LC_in) and a reset signal pin (RST_in).

6. The display device as claimed in claim 3, wherein the reference timing signal pins comprises: a start pulse signal pin (ST_in), a first high frequency clock signal pin (CK1_in), a second high frequency clock signal pin (CK2_in), a low frequency clock signal pin (LC_in) and a reset signal pin (RST_in).

7. The display device as claimed in claim 3, wherein the reference timing signal pins comprises: a start pulse signal pin (ST_in), a first high frequency clock signal pin (CK_in), a low frequency clock signal pin (LC_in), a reset signal pin (RST_in) and a terminate signal pin (Terminate_in).

8. The display device as claimed in claim 3, wherein the reference timing signal pins comprises: a start pulse signal pin (ST_in), a first high frequency clock signal pin (CK1_in), a second high frequency clock signal pin (CK2_in), a low frequency clock signal pin (LC_in), a reset signal pin (RST_in) and a terminate signal pin (Terminate_in).

9. An interface type selection method of a display device, comprising:

acquiring a type identification signal and identifying a P2P interface type according to the type identification signal; and transmitting a corresponding P2P data according to the P2P interface type;

wherein the P2P interface type comprises one or more of an Integrated-Stream Protocol (iSP) interface, an Unified Standard Interface for TV (USI-T), a China BOE Point-to-Point Interface (CHPI), a China Star Point-to-Point Interface (CSPI), a Clock Embedded Point-to-Point Interface (CMPI) and a Clock Embedded Differential Signal (CEDS) interface;

wherein the acquiring a type identification signal and identifying a P2P interface type according to the type identification signal, comprises:

acquiring a clock signal and at least one high/low voltage level signals transmitted by predetermined pins;

judging times of occurrence of the at least high/low voltage level signals in a time period of the clock signal; and identifying the P2P interface type according to the times of occurrence;

wherein the type identification signal comprises the clock signal and the at least one high/low voltage level signal transmitted by the predetermined pins.

10. An interface type selection method of a display device, comprising:

acquiring a type identification signal and identifying a P2P interface type according to the type identification signal; and transmitting a corresponding P2P data according to the P2P interface type;

wherein the P2P interface type comprises one or more of an Integrated-Stream Protocol (iSP) interface, an Unified Standard Interface for TV (USI-T), a China BOE Point-to-Point Interface (CHPI), a China Star Point-to-Point Interface (CSPI), a Clock Embedded Point-to-Point Interface (CMPI) and a Clock Embedded Differential Signal (CEDS) interface;

wherein the acquiring a type identification signal and identifying a P2P interface type according to the type identification signal, comprises:

acquiring an alternating current (AC) voltage level signal with a preset rule transmitted by a predetermined pin;

judging a ratio between a high voltage level and a low voltage level in the AC voltage level signal with the preset rule; and identifying the P2P interface type according to the ratio;

wherein the type identification signal is the AC voltage level signal with the preset rule.

* * * * *